US005505505A

United States Patent [19]

Follows

[11] Patent Number: 5,505,505

[45] Date of Patent: Apr. 9, 1996

[54] DEVICE FOR SECURING A CLOSURE SUCH AS A WINDOW

[75] Inventor: James S. Follows, South Surrey, Canada

[73] Assignee: VanGuard Plastics (1971) Ltd., Surrey, Canada

[21] Appl. No.: 254,362

[22] Filed: May 10, 1994

[51] Int. Cl.[6] ..... E05C 5/04

[52] U.S. Cl. ..... 292/58; 292/DIG. 20; 292/DIG. 47

[58] Field of Search ..... 292/57, 58, DIG. 20, 292/DIG. 35, DIG. 47, DIG. 46, 251

[56] References Cited

U.S. PATENT DOCUMENTS

| | | | |
|---|---|---|---|
| 2,961,263 | 11/1960 | Ahlgren | 292/DIG. 20 X |
| 3,706,467 | 12/1972 | Martin | 292/DIG. 47 X |
| 4,635,976 | 1/1987 | Sigler | 292/57 |
| 4,691,952 | 9/1987 | Harmon | 292/241 X |
| 4,826,222 | 5/1989 | Davis . | |
| 4,932,694 | 6/1990 | Cater, Sr. | 292/DIG. 46 X |
| 5,042,855 | 8/1991 | Bennett | 292/DIG. 20 X |
| 5,106,251 | 4/1992 | Steinbach | 292/251 X |
| 5,342,102 | 8/1994 | Takimoto | 292/DIG. 46 X |

*Primary Examiner*—Steven N. Meyers
*Assistant Examiner*—Monica E. Millner
*Attorney, Agent, or Firm*—John C. Hunt

[57] ABSTRACT

A device for securing a closure. An illustrated latching device is for releasably securing a closure such as a window. The device includes a base for mounting, typically to a pivotally mounted window frame. The base has an upstanding hollow threaded shaft. There is a handle having a downwardly depending threaded cylinder the threads mating with the threads of the shaft to permit rotation of the handle between lower and upper positions. The handle includes an abutment for abutting a surrounding window frame to preclude relative movement of the pivotal frame when the handle is in the lower position. There is a downwardly open cap of resiliently deformable material connected to a downwardly directed stem extending from an upper interior end of the cylinder and received within an interior of the hollow shaft and abutments extending radially outwardly of the cap and radially inwardly of a wall of the shaft, the abutments being located such that when the handle is in the lower position the resiliently deformable material exhibits a first stress minimum. The abutments are further located such that when the handle is in the upper position the stress of the deformable material exhibits a second stress minimum, the lower and upper positions of the handle are rotationally spaced 90° from each other, and, when the handle is rotated between the lower and upper positions, the material exhibits a stress maximum at a position rotationally intermediate the upper and lower positions of the handle.

35 Claims, 5 Drawing Sheets

DEVICE FOR SECURING A CLOSURE SUCH AS A WINDOW

FIELD OF THE INVENTION

The present invention relates to latches and the like for securing a closure, such as a window pivotally connected to its frame, in its closed position. Particularly, this invention relates to a device having a rotatable handle for mounting to a movable member of the closure such that in a first lower position the handle engages a surrounding frame of the window to preclude movement of the movable member and in a second upper position the handle is rotated away from the surrounding frame to provide clearance for movement of the member.

BACKGROUND OF THE INVENTION

Closures such as windows pivotally connected within their frames are widely known. A rectangular frame in which a pane of glass is mounted is generally pivotally connected to a surrounding frame by one or more hinges having either a horizontal or vertical pivotal axis. Especially common is a window having an inner frame pivotally mounted to an outer frame along an upper cross-member in which window may be opened by pushing a lower cross-member of the inner frame outwardly into an open position.

A variety of devices is known for securing such a window in its closed position.

One device includes a handle rotatably mounted to a lower portion of the inner frame of the window and a striker plate mounted to the lower cross-member of the outer frame into which a portion of the handle may be rotated to engage the plate. The engaging portion of the handle is generally tapered to engage the striker plate as the handle is rotated into its fully closed position so that the movable inner frame is drawn into a tightly closed position with respect to the outer surrounding frame.

Another type of device, which avoids the need for a striker plate, is described in U.S. Patent No. 4,826,222 which issued May 2, 1989 to Davis. The patent specification describes a closure latch having a handle which rotates in a plane and having movement which is coupled to a pivotal plate which can be moved into position to overlie and engage a window frame.

SUMMARY OF THE INVENTION

The present invention provides a device for releasably securing a closure such as a window in a closed position. In one embodiment, the device includes a base for mounting to one or the other of first and second frame portions of the window. Typically, the base is mounted to a lower member of a frame connected by a horizontal upper member within a surrounding frame to pivot outwardly from the surrounding frame. There is a handle threadedly mounted to the base for axial movement between extended and retracted positions as the handle is rotated with respect to the base. The handle includes abutment means located to abut the other of the first and second frame portions, typically the internal vertical surface of the lower member of the surrounding frame, to preclude relative movement of the frame portions when the handle is in the retracted position and to permit movement of the frame portions with respect to each other when the handle is in the extended position.

Preferably, the base and handle include first and second abutment surfaces, respectively, the surfaces being located to be in abutting contact with each other when the handle is in the retracted position so as to interfere with movement of the handle with respect to the base. At least one of the base or the handle includes a portion comprising resilient material to permit flexure of the resilient material during rotation of the handle from the retracted to the extended position.

The device base can include an axial shaft having threads on its exterior and the handle a cylinder open at an axial first end thereof, for receipt of the shaft therein. The threaded connection of the base and handle can be provided by threads on an interior wall of the cylinder for complementary threading with the threads of the shaft.

Further, the shaft can be hollow and the handle can include a member projecting interiorly from the axial second end of the cylinder into an interior of the shaft. The base first abutment surfaces can thus be located on an interior wall of the shaft and the handle second abutment surfaces can be located on a radially exterior portion of the member.

The projecting member can include a resiliently deformable cap received within the interior of the shaft of the base. The cap can include a plurality of circumferentially spaced apart fingers. A second abutment surface can be located on an exterior wall of each finger and the first abutment surfaces can be located on the interior of the shaft.

The member can include a stem connected to an exterior roof of the cap and the shaft can include a radially inwardly directed lip which abuts a radially outward portion of the roof when the handle is in the extended position, to act as a stop for the handle.

The handle abutment means can be of nylon, the cap of acetal, and the base of nylon, but other materials are suitable.

In a particular embodiment, distal ends of the fingers are oversized with respect to the interior of the shaft so as to obtain a snug fit of the cap within the shaft when the handle is in the retracted and extended positions.

Preferably, the extended and retracted positions are rotationally spaced approximately 90° from each other and the handle includes a grip for hand rotation and the angle of the threads is about 20° with respect to a central axis of the shaft.

In another embodiment, the device includes a base for mounting to a frame of the closure. There is a handle threadedly mounted to the base for rotatable movement along a path between upper and lower positions. The handle includes an abutment means for abutting a portion of the closure frame when the handle is in the lower position. Each of the base and handle includes abutments, at least one of the abutments is of resiliently deformable material, the location of the abutments is such that the stress of the resiliently deformable material as the handle moves along the path exhibits a minimum and a maximum at defined locations, and the lower position corresponds to a first stress minimum.

The upper position can correspond to a second stress minimum.

Further, the upper and lower positions are preferably rotationally spaced about 90° from each other on the path.

The base can include a shaft having exterior threads and the handle include a downwardly open cylinder for receipt of the shaft therein. The cylinder can have threads on an interior wall complementary to the threads of the shaft.

Preferably, the shaft is hollow and the handle includes a member projecting from the interior of the open cylinder and concentric with the cylinder wall and the abutments are located on an interior wall of the shaft and an exterior wall of the projecting member.

The upper end of the shaft can include a radially inwardly directed lip and the projecting member a downwardly directed stem received through the upper end of the shaft. There can be a downwardly open cap at the lower end of the stem, the cap having a roof which extends radially outwardly of the stem to abut the lip of the shaft of the base when the handle is in the upper position.

The cap can be secured to the stem by a screw inserted through the roof of the cap and threaded into the stem. The cap can be fixed against rotation with respect to the stem by abutment of a non-circular projection upwardly directed of the roof with a wall of an aperture in the lower end of the stem. The non-circular projection can be rectilinear or even cube-shaped.

The abutments of the projecting member can be located on the cap. The cap can include four spaced apart fingers having outer surfaces which together are generally congruent with a curved portion of an upright cone and an abutment of the handle can be a radially outwardly directed projection located on at least one of the fingers. There can be a radially outwardly directed projection on each finger.

The interior wall of the shaft can include an indentation for receipt of each of the one or more radially outwardly directed projections of the cap therein. The interior wall of the shaft might thus include four indentations, spaced evenly from each other, each for receipt of a radially outwardly directed projection of the cap therein.

The exterior of the curved portion of the cone can be tapered inwardly up to about 2° toward the axis of the cylinder, from the lower end to the top end of the cylinder. The lower diameter of the cap can be oversized with respect to a corresponding inner diameter of the shaft when the handle is in the lower position such that the cap is stressed so as to reduce play in the device when the handle is in the lower position.

The lower end of the cap can be flush with the bottom surface of the base when the handle is in the lower position. The lower rim of the open cylinder can abut an upwardly directed surface of the base when the handle is in the lower position.

There can be a pair of the exterior threads on the shaft.

The cap can be of resiliently deformable material and the shaft of the base of relatively rigid material.

In a particular embodiment, the invention is a device for releasably securing a closure such as a window in a closed position where the window has first and second frame portions, the first portion being movable with respect to the second portion. The device includes a base for mounting to one or the other of the first and second frame portions. The base includes an upstanding hollow shaft having threads on an exterior surface of the shaft and the shaft is open at its upper end. There is a handle having a laterally extending grip and a downwardly depending cylinder with threads on an interior wall thereof, the threads being complementary to the threads of the shaft for threading engagement thereof, to permit rotation of the handle between lower and upper positions by hand operation of the grip. The handle includes an abutment means located to abut the other of the first and second frame portions to preclude relative movement of the frame portions when the handle is in the lower position. There is a downwardly open cap of resiliently deformable material connected to a downwardly directed stem extending from an upper interior end of the cylinder and received within an interior of the hollow shaft. There are abutments extending radially outwardly of the cap and radially inwardly of a wall of the shaft, the abutments being located such that when the handle is in the lower position the deformable material exhibits a first stress minimum.

In such embodiment, the abutments are preferably further located such that when the handle is in the upper position the stress of the deformable material exhibits a second stress minimum, the lower and upper positions of the handle are rotationally spaced about 90° from each other, and, when the handle is rotated between the lower and upper positions, the material exhibits a stress maximum at a position rotationally intermediate the upper and lower positions of the handle.

BRIEF DESCRIPTION OF THE DRAWINGS

A detailed description of preferred embodiments follows with reference to the drawings in which.

DETAILED DESCRIPTION OF A PREFERRED EMBODIMENT

Figure 1:
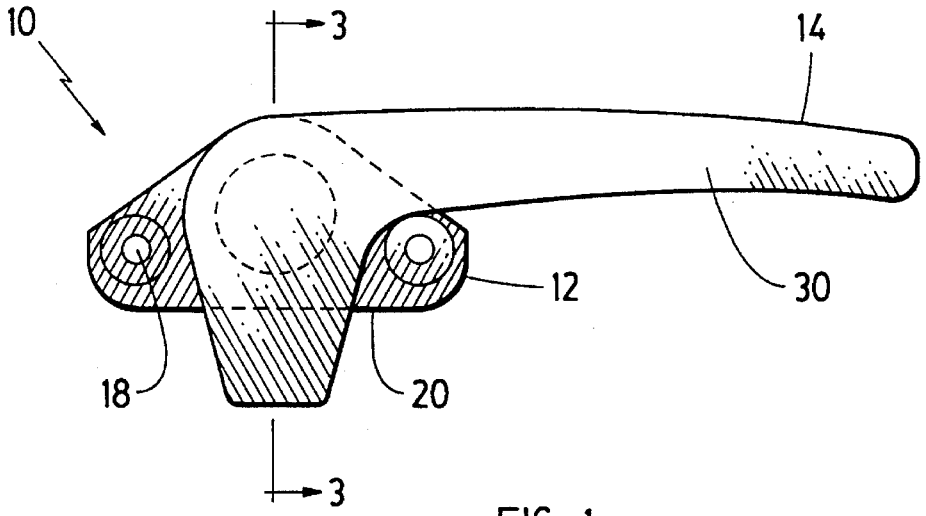
FIG. 1 is a plan view of a preferred embodiment device of the present invention in a closed position.

Turning to the drawings, a preferred embodiment device 10 for securing a window is illustrated. Device 10 is described here as it would be used in connection with a window having a movable portion which is pivotally connected to the upper cross-member of a surrounding frame. The bottom portion of such a window generally swings out to the exterior of the building in its open position.

Device 10 includes base 12 and handle 14. In the closed position of FIGS. 1 and 3, pad 16 abuts the lower cross-member of outer frame 17 of the window to hold the window in its closed position. To release the movable part of the frame for movement, handle 14 is rotated into the open position of FIG. 2 and pad 16 is rotated out of engagement with the outer frame member into a position above base 12 to provide clearance for pivotal movement of the inner window frame in the direction of arrow 19. Details of the structure and operation of the device are more fully explained below.

Figure 2:
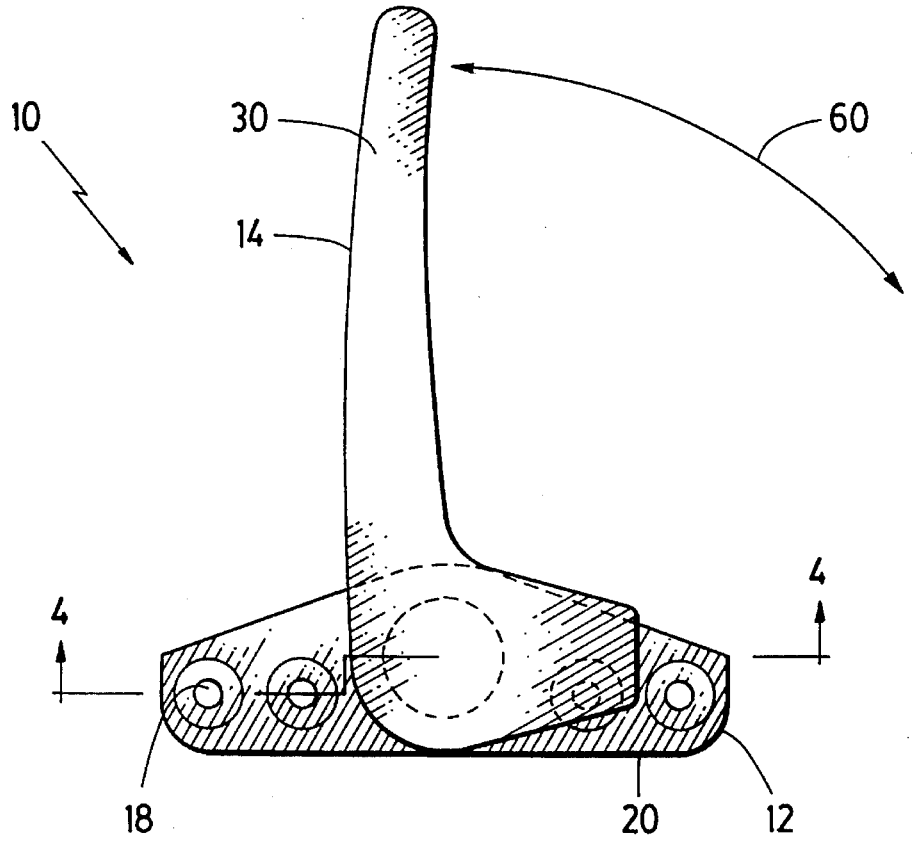
FIG. 2 is a view similar to that of FIG. 1, but the device is in an open position and a variant base is shown.

Device 10 is mounted to an inner window frame by means of screws inserted through apertures 18 located in base 12. Screws are thus threaded directly into the window frame. Alternate base configurations are shown in FIGS. 1 and 2, the larger base of FIG. 2 providing a more stable mounting. In the case of the window arrangement described here, edge 20 of the base would be located to be parallel with and just slightly above the upper edge of the lower cross-member of the outer frame of the window.

Base 12 includes upstanding shaft 22. The shaft is in the general shape of a circular cylinder open at its upper and lower ends. Exterior threads 24 run along the cylinder for mating with complementary threads 26 of the handle. Radially inwardly directed lip 28 surrounds the upper end of the shaft. The illustrated base is of nylon and the shaft and mounting portions are a single injection-molded unitary piece.

Handle 14 includes grip 30 by which the device is operated by hand. The handle includes downwardly open cylinder 32 for receipt of shaft 22 therein. The interior wall of cylinder 32 includes threads 26 which matingly engage threads 24 of shaft 22.

Handle 14 includes hollow member 34 projecting downwardly from the interior of the roof of cylinder 32 and received within the top end of shaft 22. The member includes stem 36 and locking cap or retainer 38. The stem is injection-molded as part of the handle while the cap is attached to the lower end of the stem. Cap 38 is secured to stem 36 by screw 40 received within insert 42, insert 42 being welded into the hollow of the stem and held there by friction fit. Upwardly projecting from the roof of cap 38 is rectilinear projection 44. Projection 44 is snugly received within mating aperture 46 of the stem, abutting walls of the projection and aperture thus affixing retainer 38 against rotation with respect to the rest of the handle. The retainer and stem thus rotate directly in response to movement of the grip of the handle.

Figure 4:
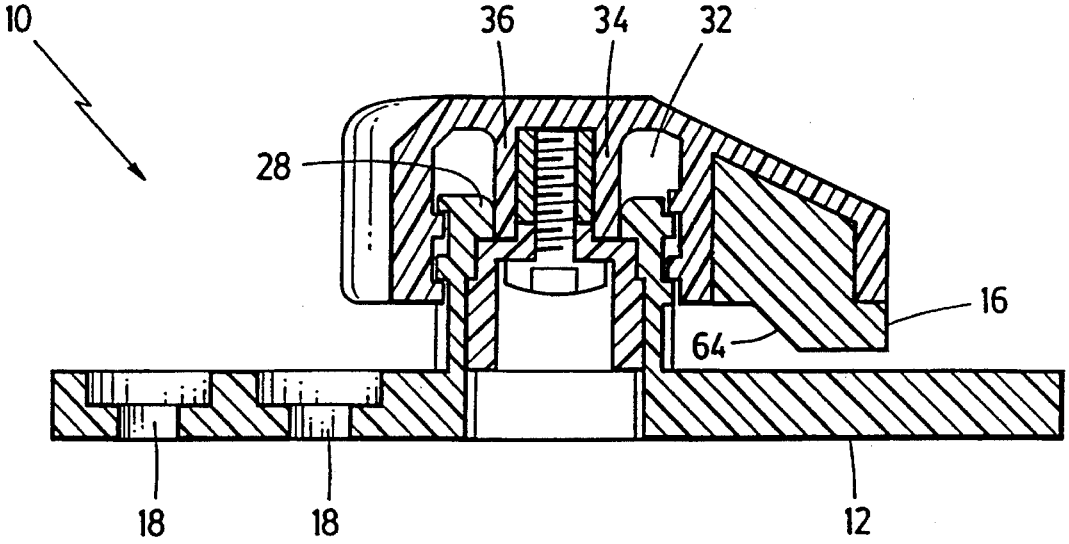
FIG. 4 is a sectional detail of the device taken along 4—4 of FIG. 2.
Figure 5:
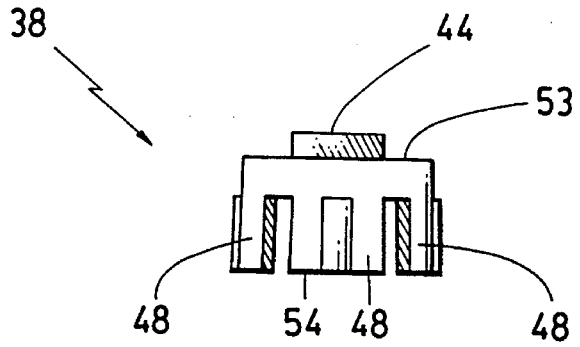
FIG. 5 is an elevation of a locking cap of the present invention.
Figure 6:
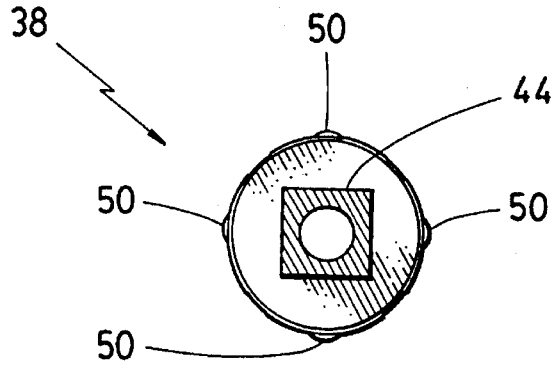
FIG. 6 is a top plan view of the cap.
Figure 7:
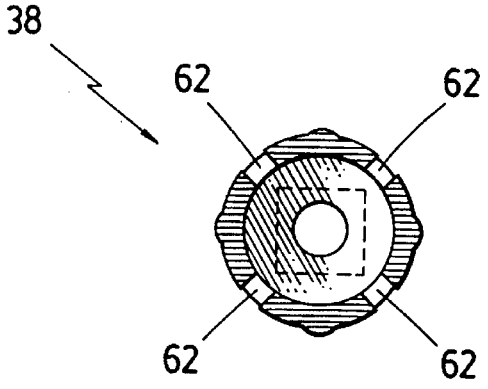
FIG. 7 is a bottom plan view of the cap.
Figure 8:
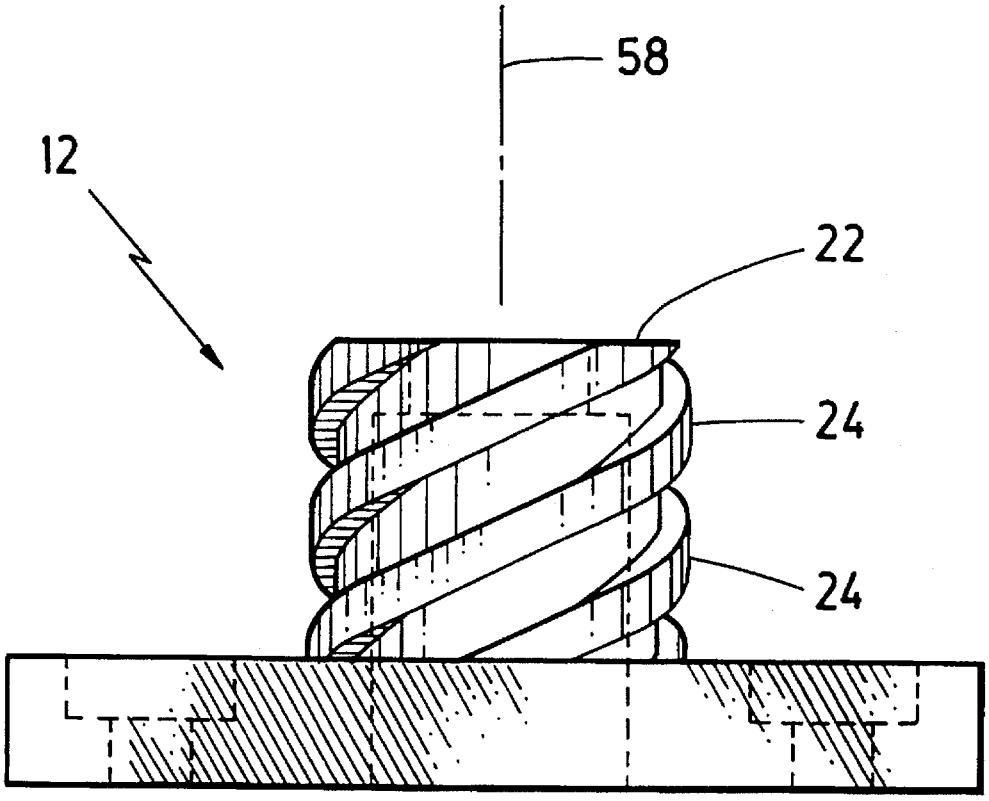
FIG. 8 is a side elevational detail of an upstanding threaded shaft of the preferred embodiment.
Figure 9:
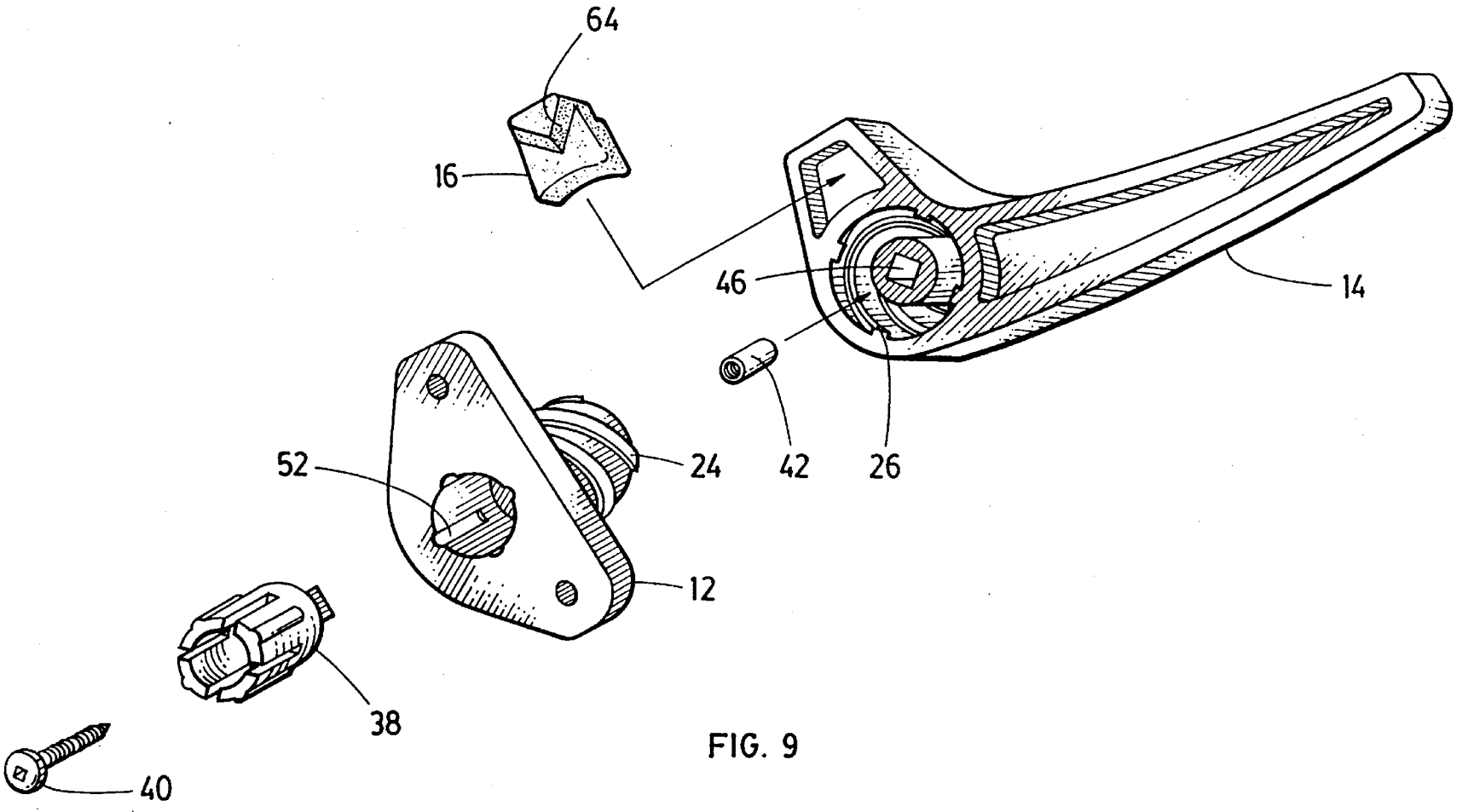
FIG. 9 is an exploded perspective of the components of the FIG. 1 embodiment.

There are four fingers 48 of the illustrated cap, the finger walls being evenly spaced from each other. The walls of the fingers together lie on the curved surface of an imaginary upright cone, the curved wall of the cone being angled about1½° with respect to the central axis of the cone. Each finger wall has a radially outwardly directed abutment or projection 50 on its exterior surface. There are four indentations or divots 52 on the interior wall of shaft 22 corresponding to the abutments 50 of the cap. Abutments 50 and indentations 52 are located so that when the handle is in its lower or closed position, each abutment is received within an indentation. Further, the abutments and indentations are located so that when the handle has been rotated 90° into its open or upper position, each abutment is received within an indentation. It will further be appreciated that the outer diameter of the cap is greater than the outer diameter of the stem and the outer portion 53 of the roof of the cap abuts the underside of lip 28 of the upstanding shaft when the handle is rotated into its open position. Lip 28 thus acts as an upper stop to rotation of the handle beyond the position shown in FIGS. 2 and 4. The lower rim 54 of the cap is flush with bottom surface 56 of the base when the handle is in its closed position.

A latching device of the present invention once mounted to a window may thus have its handle rotated 90° between its lower (closed) and upper (open) positions of FIGS. 1 and 2, respectively. When in either of these positions, the walls of handle cap abutments 50 and divots 52 abut each other. Such abutting walls are themselves referred to herein as "abutments" and serve to lock the handle with respect to the base in the closed position or the open position, as the case may be. The retainer, or cap 38, is of resiliently deformable material, that is, a plastic which can be stressed out of shape by applied pressure but which will return to its original shape after release of the pressure. The base, including the upstanding shaft, of the disclosed embodiment is of relatively rigid nylon while the cap is of acetal, which has suitable memory. The cap can be of a relatively flexible material, if desired. It will be appreciated that when in either of the open or closed positions the cap is in a relatively relaxed, i.e., relatively unstressed condition, while as the handle is rotated about the central axis 58 of the shaft in the direction of arrow 60 between positions the abutting surfaces of the cap and shaft, the abutments, force the cap into a slightly compressed or stressed state. The abutments thus tend to interfere with movement of the handle from one position to the other, or put another way, once the handle is rotated into one of the open or closed positions, the handle tends to want to stay in its position. Gaps 62 between the retainer fingers permit further deformation of the cap than if the cap included a continuous curved wall. In the disclosed embodiment stress minima are obtained when the handle is in its open and closed positions while a stress maximum is exhibited intermediate these two positions. It will be appreciated that there are other arrangements of abutments which would provide stress minima and maxima along the path of movement of the handle.

In an alternate configuration, the abutments 50 of the cap fingers extend only partially up the length of the fingers rather than being coextensive with gaps 62 between the retainer fingers. This eases the effort required to dislodge an abutment from its divot or channel 52 relative to the illustrated embodiment, since it lowers the point of the uppermost abutting surfaces with respect to the pivot point of a finger. Abutments 50 could also themselves be tapered inwardly and upwardly.

Figure 3:
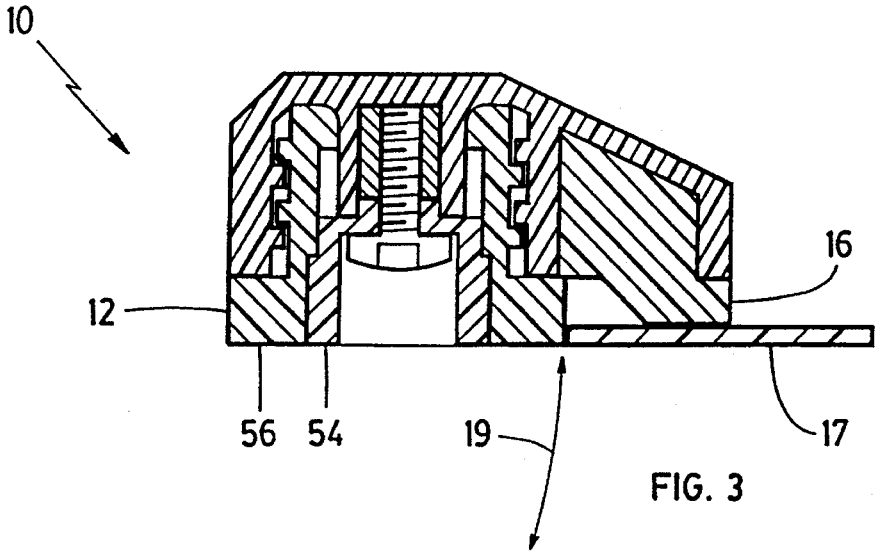
FIG. 3 is a sectional detail of the device taken along 3—3 of FIG. 1.

Pad 16 is moved into and out of engaging position with respect to a stationary cross-member of the outer frame of a window by rotation of the handle. In the closed position, the pad provides an abutment means which laterally extends beyond the base in a plane orthogonal to axis of rotation 58 of the handle as shown in FIGS. 1 and 3. The orientation of the abutment surface provided by pad 16 does not change with rotation of the handle, but rises laterally away from the cross-member by means of threads 24, 26 to provide clearance for movement of the pivotally movable inner portion of the window to which the device is mounted.

Pad 16 of the disclosed embodiment is of nylon, a relatively non-abrasive material. Any suitable non-abrasive material can be used. The pad, although it directly abuts a portion of the window frame produces minimal marking thereof. The pad is configured such that its abutment surface is essentially coplanar with the surface of the surrounding frame with which it abuts when the device is in the closed (retracted) position. The angle of rise of the threads, 20°, is great enough that the pad rises suitably out of such abutting contact over the 90° rotation of the handle into its open position. At the same time, the angle of rise is gentle enough to permit the inner portion of the window to be conveniently drawn into its closed position with respect to the outer frame as the handle is rotated from its extended into its retracted position.

It might be desirable, under certain circumstances, for the pad to be of a material having a higher coefficient of friction than that of nylon or possibly for the pad to be of a more flexible material. Use of such a material could enhance locking of the handle into its closed position. A pad of urethane having a hardness rating of between about 70A and 95A could well be found to be suitable. Care should be taken to avoid pad material which might lead to freezing of the handle in place, or of excessive marking of the outer window frame.

As previously mentioned, the curved wall portions of the cap are tapered slightly inwardly and upwardly, about 1½° from the vertical. The lower outer diameter of cap 38 (at rest, i.e., prior to installation within the upstanding shaft) is slightly oversized with respect to the corresponding inner diameter of upstanding shaft 22, as taken when the device is in its open and closed positions. The upper diameter of the cap is dimensioned to fit within the interior of the shaft so as to move vertically freely therewithin. The lower portions of the fingers are thus squeezed or slightly compressed even when the device is in either the closed or open positions. This ensures a snug fit with little "play" in the device even when the cap is in either of its relatively unstressed positions. The angle of taper could be 2° or more.

The mating threads of handle 14 and shaft 22 serve to raise the handle with respect to the base as the handle is rotated from the closed to the open position. Nylon pad 16 snaps into opening 63 in the underside of the handle. The pad is provided with chamfered portions 64 which provide a cutaway or notch. The angle of the surfaces 64 matches the angle of rise in thread 24. The pad is thus shaped to provide clearance for the base as the handle rises upon being rotated from the lower to the upper position. It might be desirable, with a differently shaped pad, to shape a portion of the base correspondingly to provide clearance for the abutment pad.

The handle of the disclosed embodiment, including the cap is of acetal material, the underside of the handle being hollowed out to conserve materials. Screw 40 and insert 42 would typically be of brass. Other suitable materials for the various components of the disclosed embodiment would be known to those skilled in the art.

The disclosed device has been described as installed on a window frame member parallel to a member pivotally connected to a surrounding window frame. Its open and closed positions have been synonymously described as being the upper (extended) and lower (retracted) positions. Such reference orients the various components of the device with respect to each other, but obviously, the device could be installed in various orientations, depending upon the need.

The disclosed device is for hand operation with typically sized windows, etc. and would have an overall height of about 0.8 inches (2 cm) in the closed position and about 1 inch (2.5 cm) in the open position.

The preferred embodiment of the invention having been described, the scope of protection sought for the invention is set out in the appended claims.

What is claimed is:

1. A device for releasably securing a closure such as a window in a closed position in which the closure includes an inner frame pivotally connected to an outer frame, the device comprising:

a base for mounting to the inner frame; and a handle threadedly mounted to the base for rotatable movement along a path between upper and lower positions, the handle including an abutment means extending laterally beyond the base for abutting a portion of the outer frame to hold the closure in the closed position when the handle is in the lower position, and the abutment means being rotated out of engagement with the outer frame into a position above the base to provide clearance for movement of the handle past the outer frame to permit opening of the closure when the handle is in the upper position; and wherein, each of the base and handle includes abutments, at least one of the abutments is of resiliently deformable material, the abutments are located to contact each other such that stress of the resiliently deformable material as the handle moves along the path exhibits a minimum and a maximum at defined locations, and the lower position corresponds to a first stress minimum; and the abutment means and the base are shaped to provide clearance for the abutment means past the base as the handle is moved between the upper and lower positions.

2. The device of claim 1 wherein the upper position corresponds to a second stress minimum.

3. The device of claim 2 wherein the upper and lower positions are rotationally spaced about 90° from each other on the path.

4. The device of claim 2 wherein the base includes a shaft having exterior threads and the handle includes a downwardly open cylinder for receipt of the shaft therein, the cylinder having threads on an interior wall complementary to the threads of the shaft.

5. The device of claim 4 wherein:

the shaft is hollow and the handle includes a member projecting from the interior of the open cylinder and concentric with the cylinder wall; and said abutments are located on an interior wall of the shaft and an exterior wall of the projecting member.

6. The device of claim 5 wherein an upper end of the shaft includes a radially inwardly directed lip and the projecting member comprises a downwardly directed stem received through the upper end of the shaft, and a downwardly open cap at the lower end of the stem, the cap having a roof which extends radially outwardly of the stem to abut the lip of the shaft of the base when the handle is in the upper position.

7. The device of claim 6 wherein the cap is secured to the stem by a screw inserted through the roof of the cap and threaded into the stem.

8. The device of claim 7 wherein the cap is fixed against rotation with respect to the stem by abutment of a non-circular projection upwardly directed of the roof with a wall of an aperture in the lower end of the stem.

9. The device of claim 8 wherein the abutments of the projecting member are located on the cap.

10. The device of claim 9 wherein the cap includes four spaced apart fingers having outer surfaces which together are generally congruent with a curved portion of an upright cone and a said abutment of the handle comprises a radially outwardly directed projection located on at least one of the fingers.

11. The device of claim 10 wherein there is a said radially outwardly directed projection on each finger.

12. The device of claim 10 wherein the interior wall of the shaft includes an indentation for receipt of a said radially outwardly directed projection of the cap therein.

13. The device of claim 11 wherein the interior wall of the shaft includes four indentations, spaced evenly from each other, each for receipt of a said radially outwardly directed projection of the cap therein.

14. The device of claim 12 wherein the exterior of the curved portion of the cone is tapered inwardly up to about 2° toward the axis of the cylinder, from the lower end to the top end of the cylinder.

15. The device of claim 14 wherein a lower diameter of the cap is oversized with respect to a corresponding inner diameter of the shaft when the handle is in the lower position such that the cap is stressed so as to reduce play in the device when the handle is in the lower position.

16. The device of claim 6, wherein a lower end of the cap is flush with the bottom surface of the base when the handle is in the lower position.

17. The device of claim 4, wherein a lower rim of the open cylinder abuts an upwardly directed surface of the base when the handle is in the lower position.

18. The device of claim 4, wherein there is a pair of said exterior threads on the shaft.

19. The device of claim 5 wherein the projecting member is of resiliently deformable material.

20. The device of claim 11 wherein the cap is of resiliently deformable material and the shaft of the base is relatively rigid.

21. A device for releasably securing a closure such as a window in a closed position, the window having first and second frame portions, the first portion being pivotally connected to the second portion, the device comprising:

a base for mounting to one or the other of the first and second frame portions; and a handle threadedly mounted to the base for movement along an axis between extended and retracted positions as the handle is rotated about the axis with respect to the base, the handle including abutment means extending laterally beyond the base to be located to abuttingly engage the other of the first and second frame portions to preclude relative movement of the frame portions when the handle is in the retracted position and the abutment means being rotated out of engagement with the other of the first and second frame portions into a position above the base to provide clearance for movement of the handle past said other portion to permit movement of the frame portions with respect to each other when the handle is in the extended position; and wherein, the abutment means and the base are shaped to provide clearance for the abutment means past the base as the handle is moved between the extended and retracted positions.

22. The device of claim 21 wherein, the base and handle include first and second abutment surfaces, respectively, said surfaces being located to be in abutting contact with each other when the handle is in the retracted position so as to interfere with movement of the handle with respect to the base and wherein at least one of the base or the handle includes a portion comprising resilient material to permit flexure of the resilient material during rotation of the handle from the retracted to the extended position.

23. The device of claim 22 wherein, the base includes an axial shaft having threads on its exterior and the handle includes a cylinder open at an axial first end thereof, for receipt of the shaft therein, the cylinder having threads on an interior wall for complementary threading with the threads of the shaft.

24. The device of claim 23 wherein the shaft is hollow and the handle includes a member projecting interiorly from an axial second end of the cylinder into an interior of the shaft, and the base first abutment surfaces are located on an interior wall of the shaft and the handle second abutment surfaces are located on a radially exterior portion of the member.

25. The device of claim 24 wherein the projecting member includes a resiliently deformable cap received within the interior of the shaft of the base.

26. The device of claim 25 wherein the cap includes a plurality of circumferentially spaced apart fingers.

27. The device of claim 26 wherein a said second abutment surface is located on an exterior wall of each finger.

28. The device of claim 27 wherein said first abutment surfaces are located on the interior of the shaft.

29. The device of claim 28 wherein the member includes a stem connected to an exterior roof of the cap and the shaft includes a radially inwardly directed lip which abuts a radially outward portion of the roof when the handle is in the extended position, to act as a stop therefor.

30. The device of claim 29 wherein the handle abutment means is of nylon, the cap is of acetal, and the base is of nylon.

31. The device of claim 29 wherein distal ends of the fingers are oversized with respect to the interior of the shaft so as to obtain a snug fit of the cap within the shaft when the handle is in the retracted and extended positions.

32. The device of claim 31 wherein the extended and retracted positions are rotationally spaced approximately 90° from each other.

33. The device of claim 32 wherein the handle includes a grip for hand rotation and the threads have an angle of about 20° with respect to a central axis of the shaft.

34. A device for releasably securing a closure such as a window in a closed position, the window having first and second frame portions, the first portion movable with respect to the second portion, the device comprising:

a base for mounting to one or the other of the first and second frame portions;

wherein, the base includes an upstanding hollow shaft having threads on an exterior surface of the shaft, the shaft being open at an upper end thereof; and a handle having a laterally extending grip and a downwardly depending cylinder with threads on an interior wall thereof, the threads being complementary to the threads of the shaft for threading engagement thereof, to permit rotation of the handle between lower and upper positions by hand operation of the grip;

wherein, the handle includes an abutment means located to abut the other of the first and second frame portions to preclude relative movement of the frame portions when the handle is in the lower position;

there is a downwardly open cap of resiliently deformable material connected to a downwardly directed stem extending from an upper interior end of the cylinder and received within an interior of the hollow shaft; and there are abutments extending radially outwardly of the cap and radially inwardly of a wall of the shaft, said abutments being located such that when the handle is in the lower position the deformable material exhibits a first stress minimum.

35. The device of claim 34 wherein the abutments are further located such that when the handle is in the upper position the stress of the deformable material exhibits a second stress minimum, the lower and upper positions of the handle are rotationally spaced 90° from each other, and, when the handle is rotated between the lower and upper positions, the material exhibits a stress maximum at a position rotationally intermediate the upper and lower positions of the handle.

* * * * *